US006398615B1

(12) United States Patent
Wu et al.

(10) Patent No.: US 6,398,615 B1
(45) Date of Patent: Jun. 4, 2002

(54) PINWHEEL ASSEMBLY

(76) Inventors: Pao-Chang Wu, 3F, 22, Lane 40, Second Pao An St., Su Lin Town, Taipei Shien (TW); Ping-Chao Lin, 9811 Talleyan Dr., Austin, TX (US) 78750

( * ) Notice: Subject to any disclaimer, the term of this patent is extended or adjusted under 35 U.S.C. 154(b) by 0 days.

(21) Appl. No.: 09/838,737

(22) Filed: Apr. 19, 2001

(51) Int. Cl.[7] ..... A63H 33/40
(52) U.S. Cl. ..... 446/217; 446/236; 40/440
(58) Field of Search ..... 40/440; 446/217, 446/218, 236, 237, 238, 243

(56) References Cited

U.S. PATENT DOCUMENTS 3,747,263 A * 7/1973 Grossberg ..... 446/217

5,836,800 A * 11/1998 Liu ..... 446/236

* cited by examiner

*Primary Examiner*—Jacob K. Ackun
(74) *Attorney, Agent, or Firm*—Alan Kamrath; Rider, Bennett, Egan & Arundel, LLP

(57) ABSTRACT

A pinwheel assembly has a main shaft, a plurality of curved rods, a first rotating wheel, a second rotating wheel, a third rotating wheel, a fourth rotating wheel, and a plurality of fabric vanes. The main shaft passes through the first rotating wheel, the second rotating wheel, the third rotating wheel, and the fourth rotating wheel. Each of the curved rods is connected to the first rotating wheel and the fourth rotating wheel. Each of the fabric vanes is connected to the second rotating wheel and the third rotating wheel.

2 Claims, 6 Drawing Sheets

PINWHEEL ASSEMBLY

BACKGROUND OF THE INVENTION

The present invention relates to a pinwheel assembly. More particularly, the present invention relates to a pinwheel assembly which has a plurality of rotating vanes.

A conventional pinwheel has a plurality of paper vanes. The paper vanes are disposed on a shaft.

SUMMARY OF THE INVENTION

An object of the present invention is to provide a pinwheel assembly which has a plurality of rotating pinwheels to be rotated by a wind.

Another object of the present invention is to provide a pinwheel assembly which is easily assembled.

Accordingly, a pinwheel assembly comprises a main shaft, a plurality of curved rods, a first rotating wheel, a second rotating wheel, a third rotating wheel, a fourth rotating wheel, and a plurality of fabric vanes. The main shaft passes through the first rotating wheel, the second rotating wheel, the third rotating wheel, and the fourth rotating wheel. The first rotating wheel has a plurality of first through holes. The second rotating wheel has a plurality of second through holes. The third rotating wheel has a plurality of third through holes. The fourth rotating wheel has a plurality of fourth through holes. Each of the curved rods is connected to the first rotating wheel and the fourth rotating wheel. Each of the fabric vanes is connected to the second rotating wheel and the third rotating wheel.

DETAILED DESCRIPTION OF THE INVENTION

Figure 1:
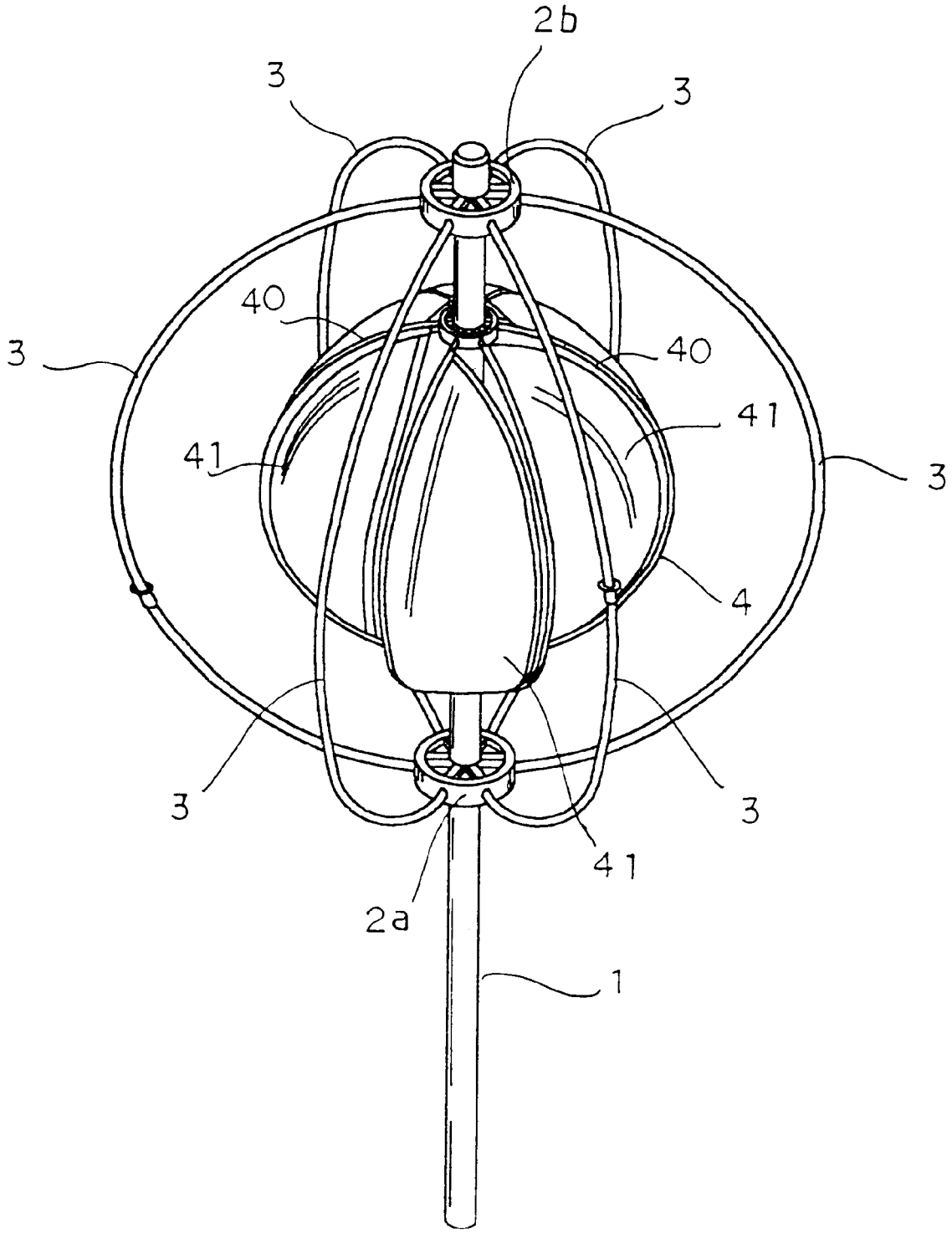
FIG. 1 is a perspective assembly view of a pinwheel assembly of a first preferred embodiment in accordance with the present invention.
Figure 2:
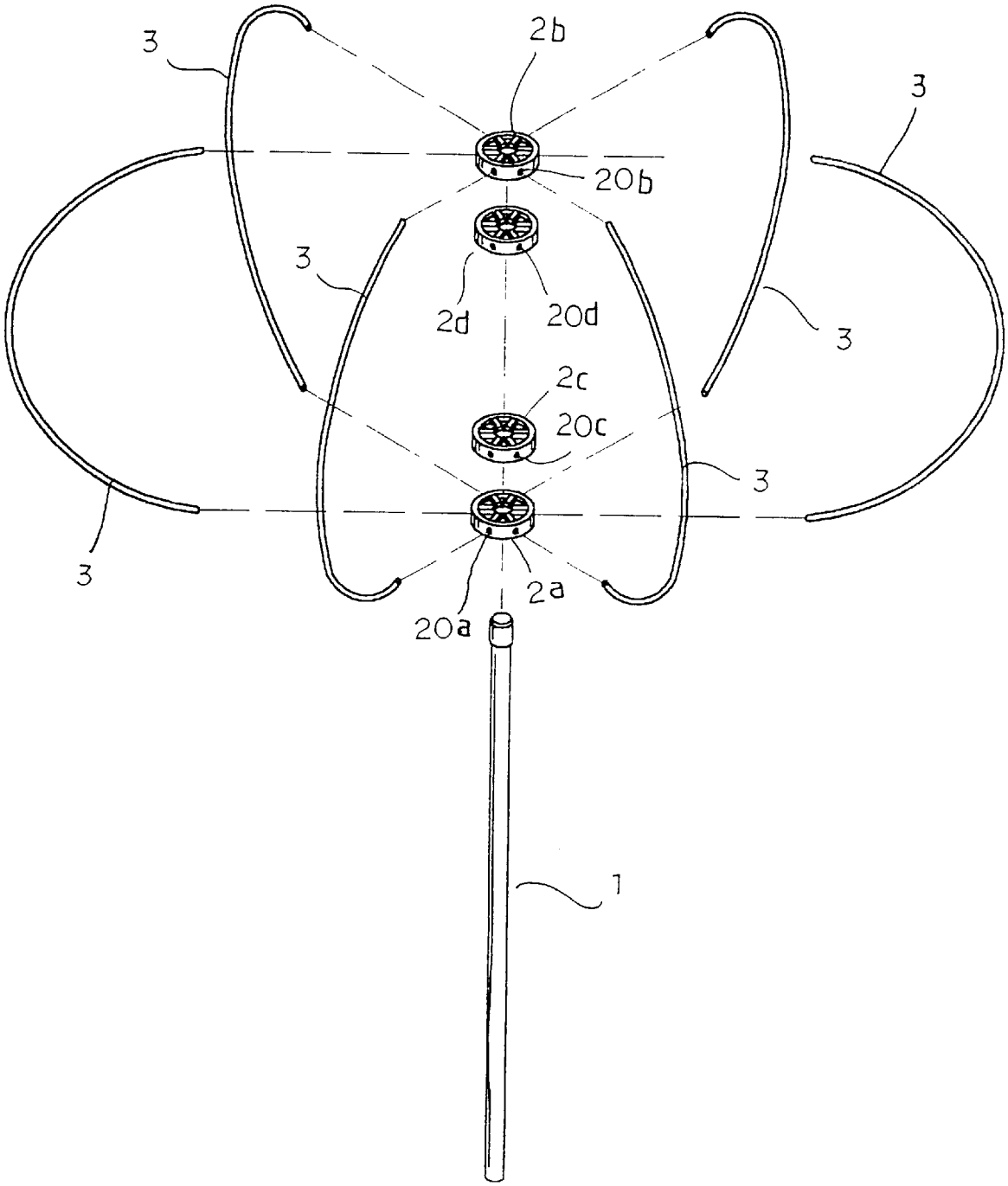
FIG. 2 is a perspective exploded view of a pinwheel assembly of a first preferred embodiment without fabric vanes.
Figure 3:
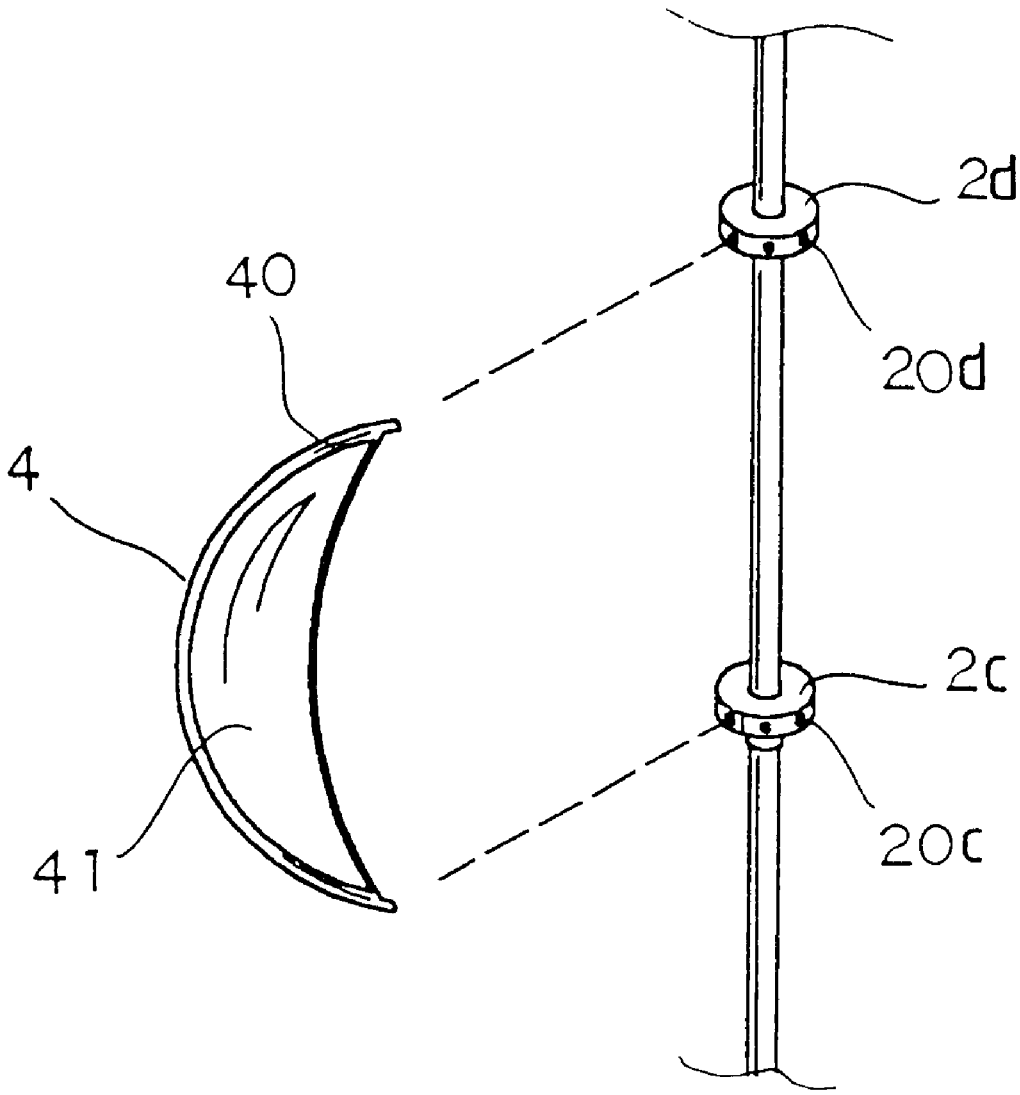
FIG. 3 is a perspective exploded view of a fabric vane and a main shaft of a first preferred embodiment in accordance with the present invention.
Figure 4:
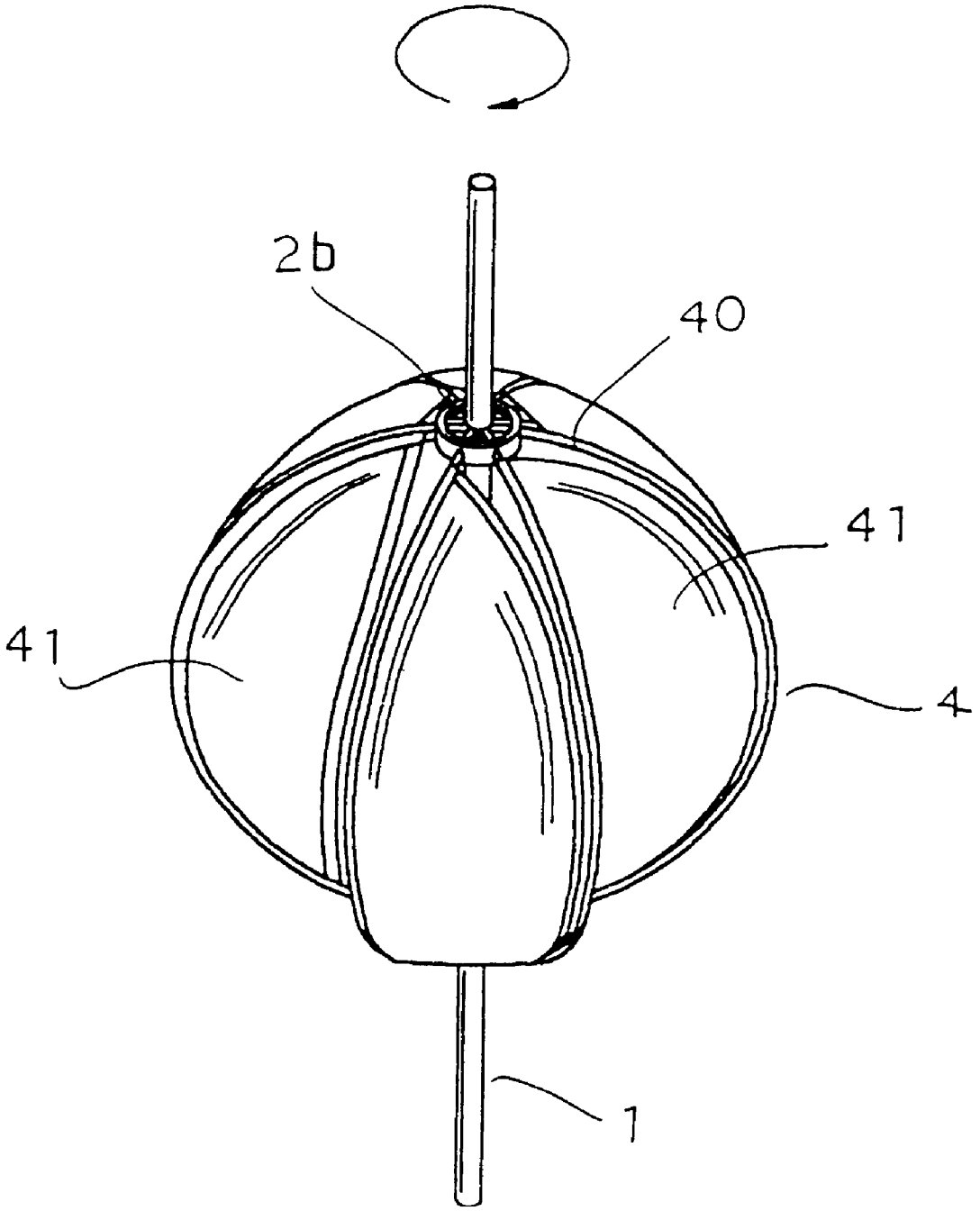
FIG. 4 is a perspective view of a rotating pinwheel of a first preferred embodiment in accordance with the present invention.

Referring to FIGS. 1 to 4, a first pinwheel assembly comprises a main shaft 1, a plurality of curved rods 3, a first rotating wheel 2*a*, a second rotating wheel 2*c*, a third rotating wheel 2*d*, a fourth rotating wheel 2*b*, and a plurality of fabric vanes 41.

The main shaft 1 passes through the first rotating wheel 2*a*, the second rotating wheel 2*c*, the third rotating wheel 2*d*, and the fourth rotating wheel 2*b*.

The first rotating wheel 2*a* has a plurality of first through holes 20*a*.

The second rotating wheel 2*c* has a plurality of second through holes 20*c*.

The third rotating wheel 2*d* has a plurality of third through holes 20*d*.

The fourth rotating wheel 2*b* has a plurality of fourth through holes 20*b*.

Each of the curved rods 3 is connected to the first rotating wheel 2*a* and the fourth rotating wheel 2*b*.

Each of the fabric vanes 41 is connected to the second rotating wheel 2*c* and the third rotating wheel 2*d*.

Each of the fabric vanes 41 has a reinforced rib 40. A rotating pinwheel 4 is formed by the fabric vanes 41.

Figure 5:
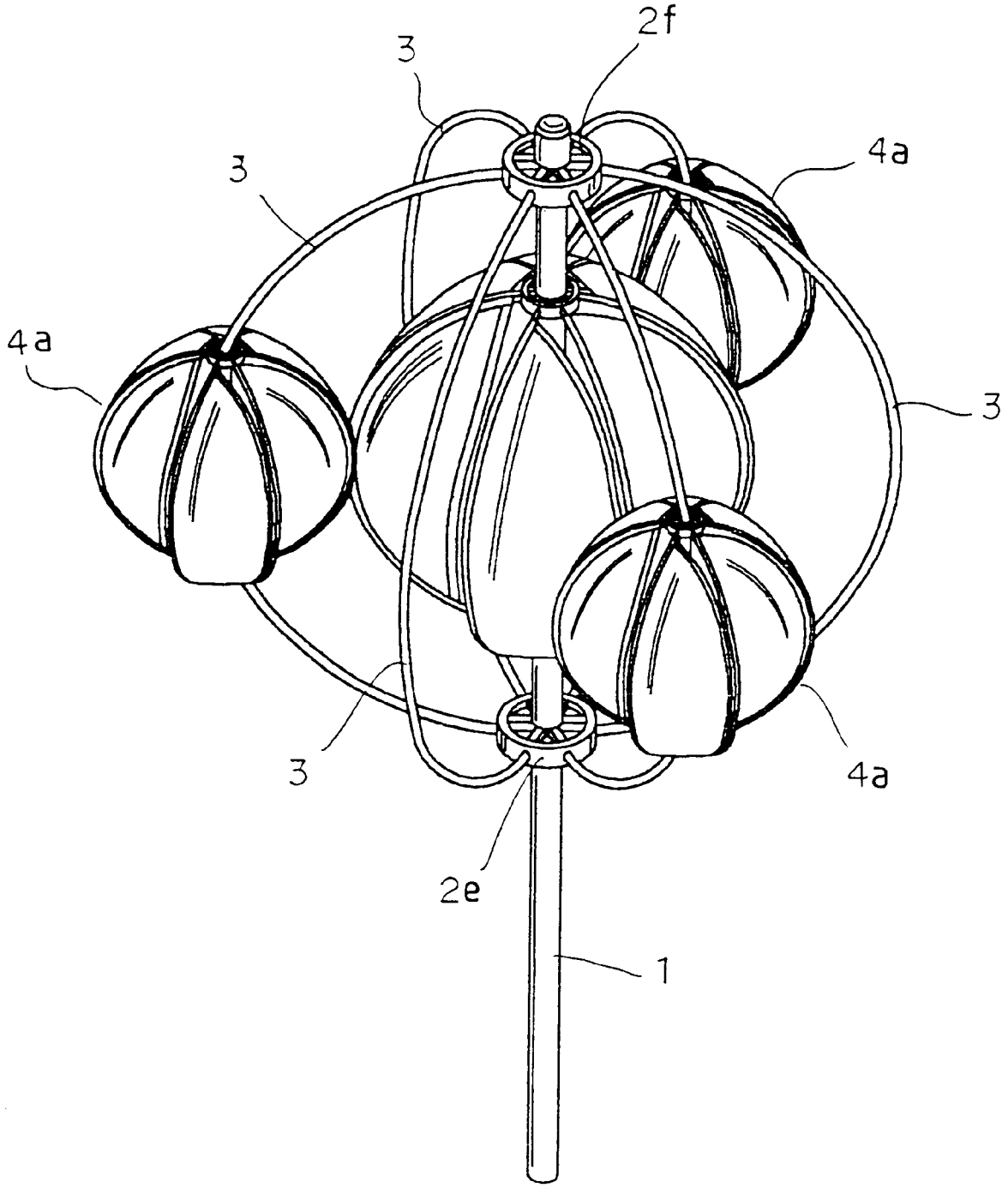
FIG. 5 is a perspective assembly view of a pinwheel assembly of a second preferred embodiment in accordance with the present invention.

Referring to FIG. 5, a second pinwheel assembly comprises a main shaft 1, a plurality of curved rods 3, a first rotating wheel 2*e*, a second rotating wheel 2*f*, and a plurality of rotating pinwheels 4*a*.

The main shaft 1 passes through the first rotating wheel 2*e* and the second rotating wheel 2*f*.

Each of the curved rods 3 is connected to the first rotating wheel 2*e* and the second rotating wheel 2*f*.

The rotating pinwheels 4*a* are disposed on the curved rods 3.

Figure 6:
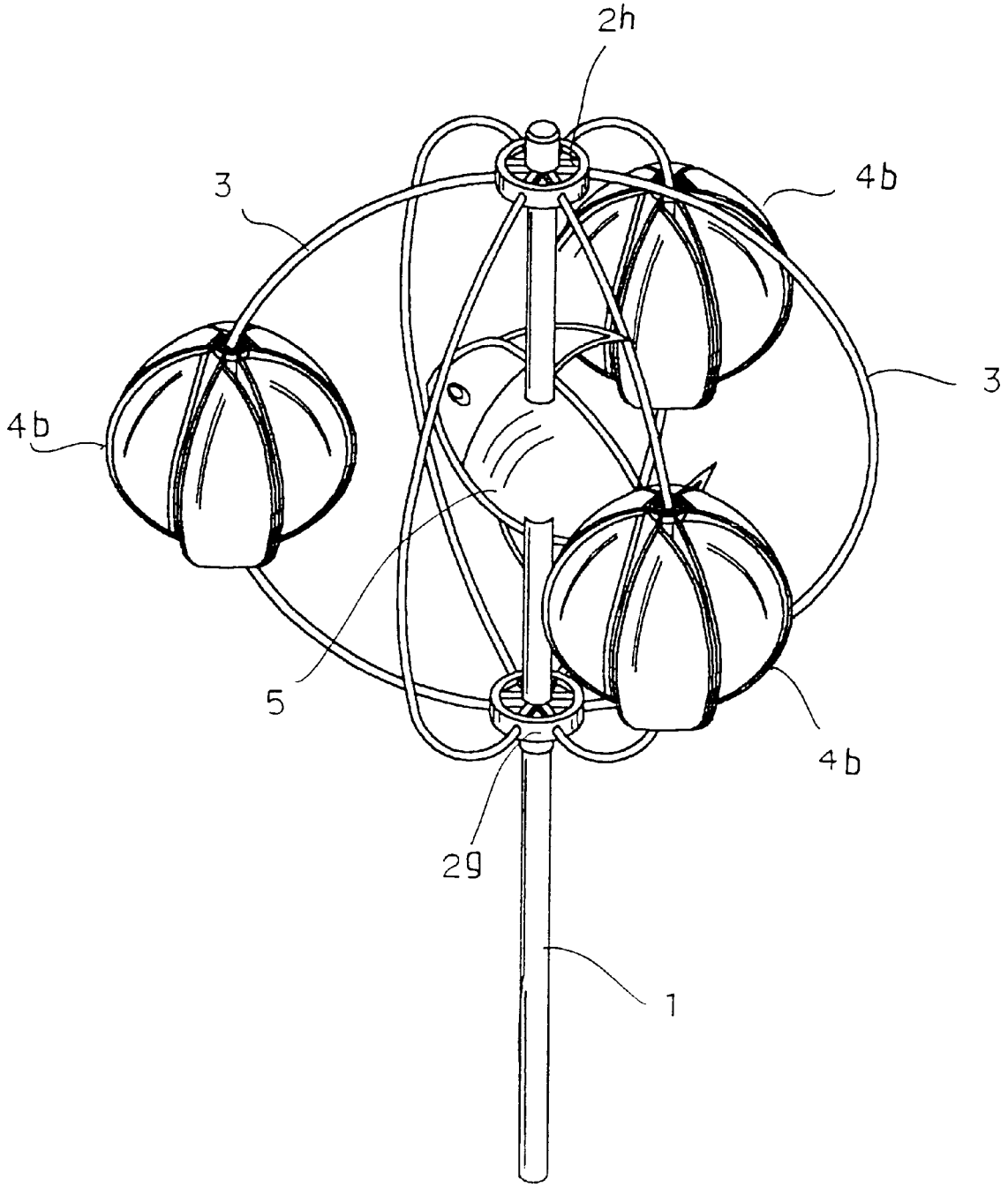
FIG. 6 is a perspective assembly view of a pinwheel assembly of a third preferred embodiment in accordance with the present invention.

Referring to FIG. 6, a third pinwheel assembly comprises a main shaft 1, a plurality of curved rods 3, a first rotating wheel 2*g*, a second rotating wheel 2*h*, and a plurality of rotating pinwheels 4*b*.

The main shaft 1 passes through the first rotating wheel 2*g* and the second rotating wheel 2*h*.

Each of the curved rods 3 is connected to the first rotating wheel 2*g* and the second rotating wheel 2*h*.

The rotating pinwheels 4*b* are disposed on the curved rods 3.

A decoration article 5 is disposed on a center of the main shaft 1.

The present invention is not limited to the above embodiments but various modification thereof may be made. Furthermore, various changes in form and detail may be made without departing from the scope of the present invention.

We claim:

1. A pinwheel assembly comprises:

a main shaft, a plurality of curved rods, a first rotating wheel, a second rotating wheel, a third rotating wheel, a fourth rotating wheel, and a plurality of fabric vanes, the main shaft passing through the first rotating wheel, the second rotating wheel, the third rotating wheel, and the fourth rotating wheel, the first rotating wheel having a plurality of first through holes, the second rotating wheel having a plurality of second through holes, the third rotating wheel having a plurality of third through holes, the fourth rotating wheel having a plurality of fourth through holes, each of the curved rods connected to the first rotating wheel and the fourth rotating wheel, and each of the fabric vanes connected to the second rotating wheel and the third rotating wheel.

2. The pinwheel assembly as claimed in claim 1, wherein each of the fabric vanes has a reinforced rib.

* * * * *